US005755384A

United States Patent [19]

Foster et al.

[11] Patent Number: 5,755,384

[45] Date of Patent: May 26, 1998

[54] DISPENSER WITH SELECTABLE DISCHARGE NOZZLE

[75] Inventors: Donald D. Foster, St. Charles; Philip L. Nelson, Ellisville, both of Mo.

[73] Assignee: Contico International, Inc., St. Louis, Mo.

[21] Appl. No.: 509,734

[22] Filed: Aug. 1, 1995

[51] Int. Cl.[6] ..... B05B 7/30

[52] U.S. Cl. ..... 239/343; 222/383.1; 239/333; 239/428.5

[58] Field of Search ..... 222/383.1; 239/333, 239/343, 428.5, 436

[56] References Cited

U.S. PATENT DOCUMENTS

| | | | |
|---|---|---|---|
| 3,967,765 | 7/1976 | Micallef | 222/554 |
| 4,204,614 | 5/1980 | Reeve | 222/383.1 X |
| 4,219,159 | 8/1980 | Wesner | 239/343 |
| 4,230,277 | 10/1980 | Tada | 222/383.1 X |
| 4,311,256 | 1/1982 | DeArmitt | 222/321 |
| 4,350,298 | 9/1982 | Tada | 239/333 |
| 4,489,861 | 12/1984 | Saito et al. | 222/207 |
| 4,669,665 | 6/1987 | Shay | 239/428.5 |
| 4,706,888 | 11/1987 | Dobbs | 239/478 |
| 4,730,775 | 3/1988 | Maas | 239/120 |
| 4,767,060 | 8/1988 | Shay et al. | 239/401 |
| 4,768,717 | 9/1988 | Shay | 239/403 |
| 4,779,803 | 10/1988 | Corsette | 239/428.5 |
| 4,883,227 | 11/1989 | Maas | 239/120 |
| 4,890,792 | 1/1990 | Martin et al. | 239/343 |
| 4,925,106 | 5/1990 | Maas et al. | 239/333 |
| 4,971,252 | 11/1990 | Tasaki et al. | 239/428.5 |
| 5,088,628 | 2/1992 | Knickerbocker | 222/383.1 X |
| 5,114,049 | 5/1992 | Knickerbocker | 222/153 |
| 5,158,233 | 10/1992 | Foster et al. | 239/333 |
| 5,161,716 | 11/1992 | Knickerbocker | 222/153 |
| 5,222,637 | 6/1993 | Gruffredi | 222/383.1 X |
| 5,234,167 | 8/1993 | Martin | 239/343 |
| 5,373,991 | 12/1994 | Nelson | 239/343 X |
| 5,397,060 | 3/1995 | Maas et al. | 239/333 |
| 5,431,345 | 7/1995 | Lund et al. | 239/343 X |

*Primary Examiner*—Joseph Kaufman
*Attorney, Agent, or Firm*—Howell & Haferkamp, L.C.

[57] ABSTRACT

A fluid dispenser is used to dispense a foaming liquid from a container either as a spray or as a foam. The dispenser comprises a housing attached to a container of the liquid, a nozzle connected to the housing, a passage extending from the container interior to the nozzle orifice, a pump positioned along the passage, a valve positioned along the passage, and a foam generator attached to the nozzle. The nozzle has an orifice through which the fluid substance is dispensed. The valve is configured for alternating movement between an open and a closed position. The foam generator is configured to move with respect to the nozzle between a foaming position and a non-foaming position and is located adjacent the nozzle orifice when in the foaming position and remote from the orifice when in the non-foaming position. Alternatively, the fluid dispenser is used to dispense a liquid from a container either as a spray or as a stream. The alternate fluid dispenser is similar to the foaming fluid dispenser except that the foam generator is replaced with a stream generator.

31 Claims, 3 Drawing Sheets

DISPENSER WITH SELECTABLE DISCHARGE NOZZLE

BACKGROUND OF THE INVENTION (1) Field of the Invention

The present invention is directed to a dispenser of the type used in dispensing liquid from a container attached to the dispenser. In particular, the dispenser of the present invention is capable of selectively alternating the pattern of the liquid discharged between a foam and a spray discharge pattern. Further, the nozzle of the dispenser of the present invention is capable of being positioned alternately in "on" and "off" positions wherein the dispenser is permitted and inhibited from dispensing the liquid, respectively. In an alternative embodiment the dispenser is selectable between spray and stream patterns, as well as, between "on" and "off" positions.

(2) Description of the Related Art

There are numerous issued patents directed to dispensers having variable discharge patterns. Generally, a dispenser of the type involved in the present invention is a relatively low-cost, hand-held device which may be operated by pulling the trigger to pump a liquid substance from the interior of a container attached to the dispenser and through a nozzle at the front of the dispenser. Dispensers of this general type have a variety of features which have become well-known in the industry. For example, many of these dispensers include a horizontally aligned or an inclined pump which may be actuated using a trigger pivotally attached to the dispenser housing. This type of dispenser is frequently referred to as a trigger sprayer. Another type of dispenser has a vertically reciprocating pump which may be actuated with the index finger to dispense liquid as a stream or a spray. This type of dispenser is frequently referred to as a finger type pump. Still another type of dispenser comprises a container and a manually operated valve where the fluid contents of the container are pressurized. When the valve is opened, the fluid is dispensed. This type of fluid dispenser is frequently referred to as an aerosol dispenser. Nonetheless, the selectable discharge pattern apparatus of the present invention is equally well-suited for use with any of these aforementioned types of fluid dispensers, as well as, most other types of fluid dispensers.

Regardless of the type of dispenser used, some of the liquids which are dispensed through the dispensers work best when applied as a spray, and other liquids work best when applied as a foam. Still other liquids sometimes work best both as a spray and as a foam, depending upon the particular characteristics which are peculiar to the application. Thus, there is a need in the fluid dispenser art for liquid dispensers which are capable of alternately discharging the liquid in a spray discharge pattern and in a foam discharge pattern. Likewise, some liquids work best for some applications when dispensed as a spray and for other applications they work best when dispensed as a stream. Thus, there is also a need in the art for liquid dispensers which are capable of alternately discharging the liquid in a spray discharge pattern and in a stream discharge pattern.

Further, it is sometimes desirable to inhibit the flow of liquid through the dispenser. For instance, when the dispenser is being stored or transported, should the dispenser and attached container be turned on their sides or inverted, it is desirable that the dispenser not leak the container contents. Thus, there is a need in the dispenser art for dispensers which are configured to alternately permit and inhibit the liquid to be dispensed. When the liquid is permitted to be dispensed, the dispenser is said to be in the "on" position and when the liquid is inhibited from being dispensed, the dispenser is said to be in the "off" position.

U.S. Pat. No. 4,350,298 of Tada discloses several embodiments of fluid dispensers. The embodiment shown in FIGS. 1–4 of that patent is a typical trigger sprayer having an orifice configured to dispense a liquid substance as a spray. A foam generator comprised of a door having a hollow bore extending therefrom is pivotally connected to the trigger sprayer housing. At one end of the bore is a grate and at the other end of the bore are four equally-spaced openings. The foam generator may be pivoted to a foaming position wherein the bore is directly in front of the nozzle orifice. When the generator is in the foaming position, the spray discharged through the nozzle orifice impinges upon the interior surface of the bore so that a turbulence is generated in the liquid spray. The openings in the bore permit air to enter the bore and to become entrapped in the liquid spray and thereby aerate the liquid and form a foam. Thus, the trigger sprayer is capable of dispensing a liquid in a spray discharge pattern and in a foam discharge pattern. However, sprayers of this type frequently do not have the capability of alternating between "on" and "off" positions. Therefore, liquid may unintentionally leak from the trigger sprayer.

U.S. Pat. No. 4,706,888 of Dobbs also discloses a trigger sprayer which is capable of alternating discharge patterns. This trigger sprayer includes a nozzle which rotates relative to the housing between "on" and "off" positions, as well as, between stream and spray discharge patterns. Both the nozzle and housing include axial slots which alternatively align and are displaced from each other as the nozzle is rotated relative to the housing. The slots in the housing lead to a recess at the front of the housing. Some of the slots in the housing enter the recess through radial slots and others enter the recess through tangential slots. When the slots in the housing and nozzle are displaced from each other, the trigger sprayer is in the "off" position. When the slots in the housing align with the axial nozzle slots which communicate with the radial slots, the sprayer is in the "on" position and the liquid is dispensed as a stream. When the slots in the housing align with the axial nozzle slots which communicate with the tangential slots, the sprayer is again in the "on" position, but the liquid is dispensed as a spray having a conical pattern as is well known in the art. Thus, the sprayer is capable of being positioned in both "on" and "off" positions, as well as, dispensing liquid in either a spray or a stream discharge pattern. However, sprayers of this type frequently do not have a capability of dispensing liquid as a foam.

U.S. Pat. No. 4,730,775 of Maas discloses yet another prior art trigger sprayer. This sprayer has a nozzle which rotates between an "off" position and an "on" position in which the liquid is dispensed as a spray. The trigger sprayer also has a detachable foam generator which may be inserted into the sprayer nozzle to cause the liquid to be discharged as a foam. Alternately, the foam generator may be removed from the nozzle to permit the liquid to be dispensed in a spray pattern. However, because in sprayers of this type the foam generator is separate from the sprayer, there is a risk of losing the foam generator, thereby eliminating the ability of the sprayer to generate a foam from the dispensed liquid.

U.S. Pat. No. 4,779,803 of Corsette discloses another type of trigger sprayer having a rotatable nozzle which may be rotated to alternate "on" and "off" positions, as well as, between stream and spray discharge patterns as described above. In addition, this trigger sprayer includes a plate having an orifice which may be moved forward and backward between a foaming and non-foaming position. When in the non-foaming position, the plate is pushed rearward to a position adjacent to the nozzle orifice so that the plate does not interfere with the liquid being dispensed. When in the foaming position, the plate is spaced forward of the plane of the nozzle orifice so that the plate interferes with the outer flowstreams of the spray being discharged from the nozzle orifice. When the plate is in the foaming position, the spray strikes the plate creating a turbulence in the spray and aerating the spray to dispense the liquid as a foam. Thus, three different discharge patterns are possible; the nozzle may be rotated between stream and spray discharge patterns and the plate may be retracted or extended to alternate between spray and foam discharge patterns. Further, the nozzle may be rotated to place the liquid dispenser in "on" and "off" positions to alternately permit and inhibit the liquid to be dispensed.

U.S. Pat. No. 4,890,792 of Martin et al. discloses a trigger sprayer having a rotatable nozzle. A plate having a grate at one location in the plate and an open hole at another is pivotally connected within the nozzle. The plate is connected to the nozzle so that as the nozzle is rotated, the plate pivots to alternately align the grate or hole with the nozzle orifice. When the hole is aligned with the nozzle orifice, the liquid is discharged from the nozzle in a spray pattern. When the grate is aligned with the orifice, the liquid strikes the grate creating a turbulence and dispensing the liquid as a foam. The nozzle may be further rotated to switch the liquid dispenser between "on" and "off" positions.

SUMMARY OF THE INVENTION

The fluid dispenser of the present invention includes a rotatable nozzle having an orifice through which the liquid is dispensed. The nozzle may be rotated between "on" and "off" positions to permit and inhibit the dispensing of the liquid, respectively. When the nozzle is in the "on" position, liquid is dispensed through the orifice in a spray discharge pattern. In one embodiment, a foam generator is provided on a pivoting door mounted on the nozzle forward of the nozzle orifice. The generator includes a tubular bore on the door. The tubular bore extends rearwardly to the nozzle orifice when the door is pivoted downwardly to its foaming position in front of the nozzle orifice. The spray of liquid from the nozzle orifice impinges on the inner surface of the bore and creates a turbulence in the liquid as it is sprayed from the orifice. Openings extend into the bore to permit air to enter the bore and aerate the liquid thereby enhancing the foaming of the liquid. The door may also be pivoted upwardly so that the bore is displaced from the nozzle orifice and positioned in its non-foaming position where the liquid is dispensed from the nozzle orifice as a spray without contacting the tubular bore. Thus, liquid may be dispensed from the fluid dispenser of the present invention as a foam or as a spray, and the nozzle may be positioned in "on" and "off" positions.

In an alternate embodiment, a stream generator is provided on a pivoting door mounted on the nozzle in place of the foam generator. This generator includes a narrow, straight passage through the door. The passage extends rearwardly to the nozzle orifice when the door is pivoted downwardly to its stream position in front of the nozzle orifice. The liquid discharged from the nozzle orifice is consolidated and accelerated to form a stream of liquid. The door may also be pivoted upwardly so that the bore is displaced from the nozzle orifice and positioned in its spray position. Thus, the liquid may be dispensed from the fluid dispenser of the alternate embodiment as a stream or as a spray, and the nozzle may be positioned in "on" and "off" positions.

BRIEF DESCRIPTION OF THE DRAWINGS

Further objects and features of the present invention are revealed in the following Detailed Description of the Preferred Embodiment of the invention and in the drawing figures wherein.

DETAILED DESCRIPTION OF THE PREFERRED EMBODIMENT

Figure 1:
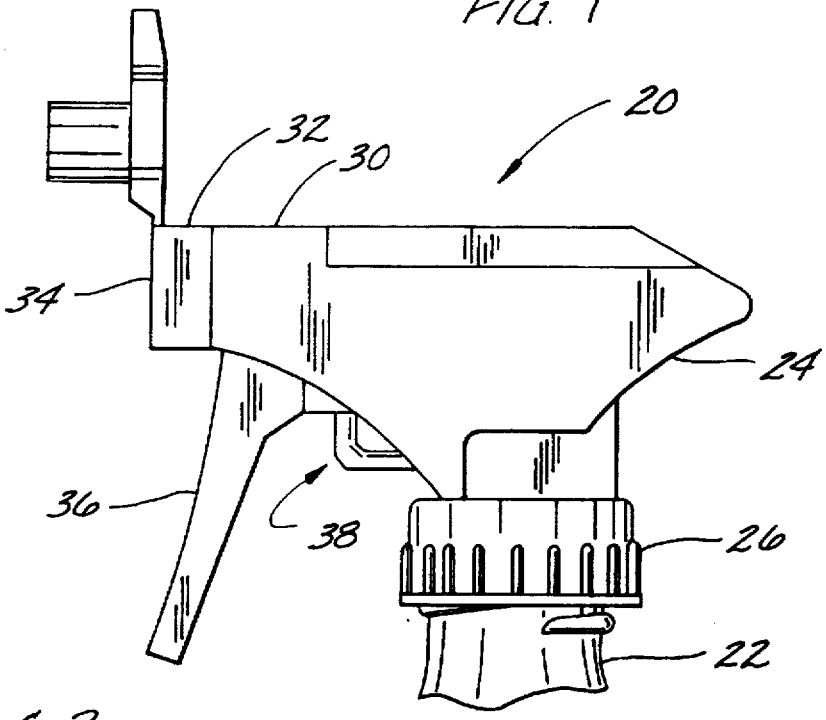
FIG. 1 is a side elevation view of a fluid dispenser of the present invention having a selectable foam/spray, on/off nozzle.

As best seen in FIG. 1, the fluid dispenser 20 of the preferred embodiment is generally comprised of a container 22 and a dispenser head 24 fastened to the container with a threaded closure 26. Although there are many types of fluid dispensers 20 to which the present invention may be adapted without departing from the scope of this invention, the dispenser of the preferred embodiment is of the trigger sprayer type.

A typical trigger sprayer includes a housing 30 having a nozzle 32 through which a liquid is dispensed. The nozzle 32 defines the front 34 of the housing 30 which the user directs away from himself or herself and toward the target area where the liquid is to be dispensed. A trigger 36 is pivotally connected to the housing 30 and is operatively connected to a pump 38 located within the housing. The trigger may be reciprocated backward and forward in actuating the pump. A passage 40 extends through the housing 30 between the container 22 and the nozzle 32 and provides fluid communication between the container and nozzle. The pump 38 is located along the passage 40 and draws the liquid from the container 22 and pumps the liquid through the passage to the nozzle 32 upon actuation of the trigger.

Figure 2:
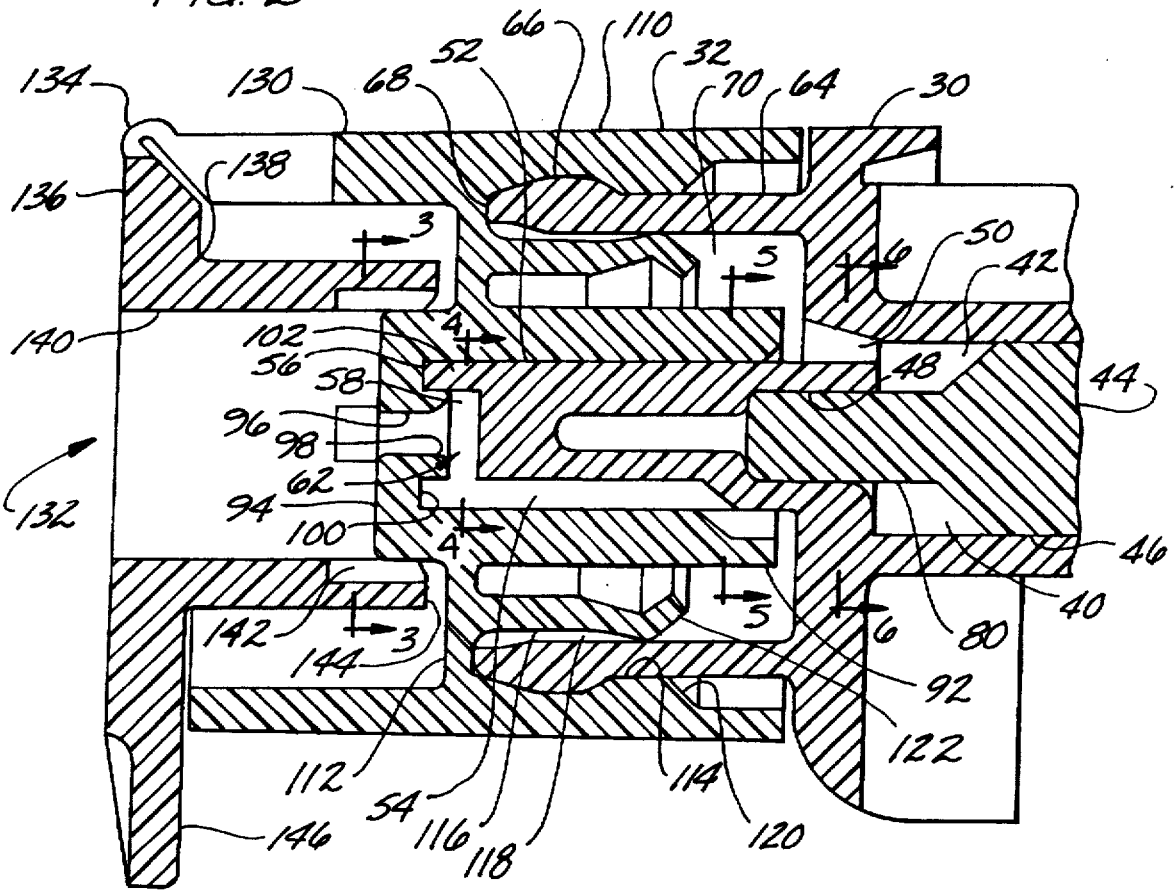
FIG. 2 is a cross-sectional view of the foam/spray, on/off nozzle of the present invention shown with the nozzle in the "on" position and the foam generator in the foaming position.
Figure 3:
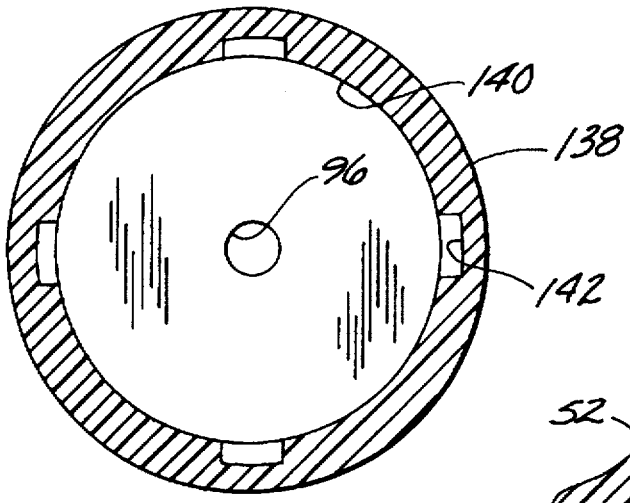
FIG. 3 is a cross-sectional view of the foam/spray, on/off nozzle taken in the plane of line 3—3 of FIG. 2.

The elements of the fluid dispenser 20 described above are typical of the prior art fluid dispensers and are well known in the art. Thus, these elements will not be described in further detail. However, a few of the elements of the fluid dispenser 20 of the preferred embodiment are novel and especially adapted for use with the nozzle 32 of the present invention. As shown in FIG. 2, the end of passage 40 adjacent the semiannular opening 50 is the liquid outlet end of a fluid discharge passage 42 which extends through the sprayer housing 30 to a liquid inlet opening (not shown) at its opposite end. The inlet opening is formed as a priming valve seat as is conventional in many trigger sprayers. A priming valve stem 44 having a T-shaped cross-section is positioned in the discharge passage 42. This stem 44 is adapted to retain a valve body (not shown) against the valve seat (not shown) at the rearward end or inlet end of the fluid discharge passage 42 to only permit liquid to pass through the discharge passage in a forward-traveling direction, as is well-known in the art. Thus, as the pump 38 is cycled between compression and suction strokes, the liquid will not be drawn rearwardly through the discharge passage 42 and into the pump on the suction stroke, but rather will be drawn from the container 22. On the compression stroke, the liquid will be pumped through the discharge passage 42 and out the semiannular opening 50 to the nozzle 32. The stem 44 T-shaped cross section has four fins 46 spacially arranged around the stem. The fins 46 fixedly center the stem in the discharge passage 42 and permit liquid to travel through the discharge passage between the fins of the stem.

Figure 4:
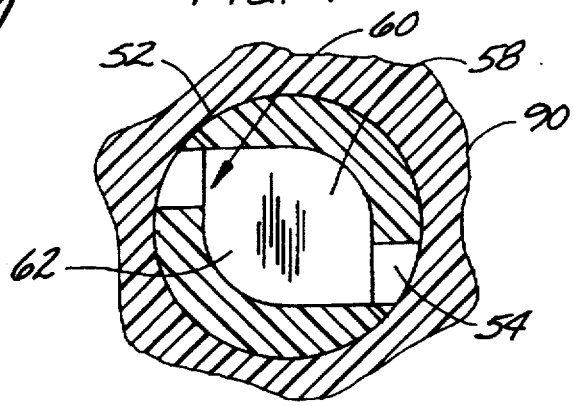
FIG. 4 is a cross-sectional view of the nozzle taken in the plane of line 4—4 of FIG. 2.
Figure 5:
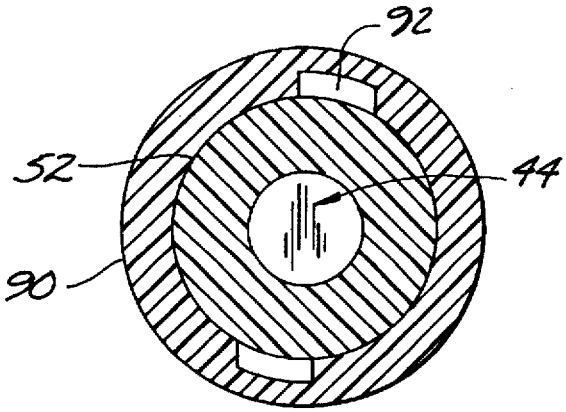
FIG. 5 is a cross-sectional view of the nozzle taken in the plane of line 5—5 of FIG. 2.
Figure 6:
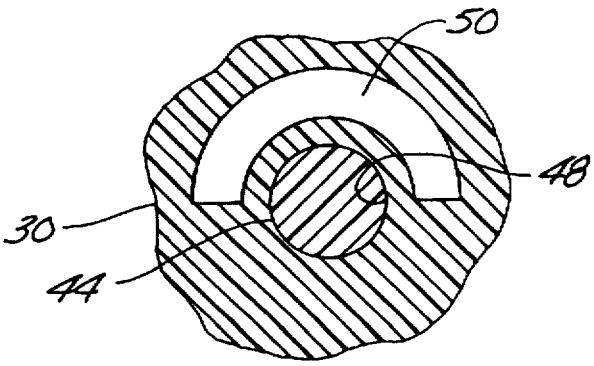
FIG. 6 is a cross-sectional view of the nozzle taken in the plane of line 6—6 of FIG. 2.

A semiannular opening 50 is formed at the front 34 of the housing 30 where the fluid exits the passage 40 as seen in FIG. 6. A cylindrical projection 52 extends forward from the housing and is centered around the centerline of the arc of the semiannular opening 50. The cylindrical projection 52 also includes a socket 48 for axially retaining and radially centering the forward end of the priming valve stem 44. This projection 52 includes two axial grooves 54 which are equally spaced about the circumference and which extend lengthwise along a portion of the length of the projection 52 to a distal end 56 of the projection. A recess 58 is formed at the distal end of the projection 52 as shown in FIGS. 2 & 4. The intersection of the axial grooves 54 with the recess 58 forms two tangential grooves 60 that extend radially from the axial grooves 54 to the circular recess 58 and form a swirl chamber 62 in combination with the recess. As the name implies, the swirl chamber 62 causes liquid passing through the chamber to spin and thereby gives the liquid a radial velocity component as it exits the fluid dispenser. The radial velocity component causes the liquid to be dispensed in a conical spray discharge pattern rather than in a stream discharge pattern as would occur if the liquid had no radial velocity component from its spinning.

A cylindrical bushing 64 having an enlarged external diameter portion 66 near its distal end 68 concentrically surrounds the cylindrical projection 52. An annular chamber 70 is formed between the exterior of cylindrical projection 52 and the interior of the cylindrical bushing 64. As the liquid pumped by the dispenser exits the passage 40 through the semiannular opening 50 it enters the annular chamber 70.

The nozzle 32 is rotatably attached to the front 34 of the housing 30 about the cylindrical projection 52 and cylindrical bushing 64. The nozzle 32 includes a cylindrical tube 90 which is sized to fit around the cylindrical projection 52. The interior diameter of the tube 90 is matched to the exterior diameter of the projection 52 to inhibit fluid from easily passing between the tube and projection, but to permit the tube to rotate about the projection without any appreciable resistance. Two axial slots 92 are formed in the interior surface of the end of the tube and are equally spaced about the circumference of the tube 90. Depending upon the rotational position of the nozzle 32 relative to the housing 30, the slots 92 may align with the axial grooves 54. When the slots 92 align with the grooves 54, the nozzle is said to be in the "on" or open position. The liquid is permitted to exit the annular chamber 70 through the slot 92 and pass through the axial grooves 54 to enter the swirl chamber 62 when the nozzle is in the "on" position. When the slots 92 are not aligned or are displaced from the grooves 54, the nozzle is said to be in the "off" or closed position wherein the liquid is inhibited from passing through the axial grooves 54 to the swirl chamber 62.

The tube 90 has an end wall 94 which rests against the distal end 56 of the projection 52 adjacent the swirl chamber 62. An orifice 96 extends through the end wall 94 immediately in front of the swirl chamber 62 as shown in FIG. 2. The upstream end 98 of the orifice 96 may be rounded to reduce fluid resistance. Therefore, the fluid is discharged with more power and propelled over a greater distance than would otherwise occur if the upstream end had sharp corners. Further, the rearward side 100 of the end wall 94 may include a circular boss 102 sized to tightly fit within the inner diameter of the swirl chamber 62.

The nozzle 32 includes an outer cylindrical wall 110 which is spaced outwardly from the cylindrical tube 90 by an annular flange 112 extending outward from the cylindrical tube 90. The inner diameter of the outer wall 110 includes a reduced diameter section 114 which is configured to engage the outer surface of the cylindrical bushing 64 immediately behind the enlarged diameter portion 66 of the bushing, thereby mounting the nozzle 32 for rotation on the housing 30. This bushing 64 and outer wall 110 configuration permits the nozzle 32 to rotate relative to the housing 30 but prevents the nozzle from becoming axially disengaged from the housing. An annular sealing sleeve 116 extends rearwardly from the annular flange 112 and engages against the inner surface of the cylindrical bushing 64 to prevent liquid from passing from the annular chamber 70 between the interface of the nozzle and housing in the vicinity of the cylindrical bushing 64. An annular space 118 is formed between the outer wall 110 and the sealing sleeve 116 into which the cylindrical bushing 64 is inserted in assembling the nozzle 32 to the housing 30. The rearward ends 120, 122 of the reduced diameter section 114 and the sealing sleeve 116 are chamfered to ease insertion of the cylindrical bushing 64 into the annular space 118 during the initial assembly.

A tubular portion 130 of the nozzle 32 extends forwardly from the annular flange 112. Hinged to this portion 130 is a foam generator 132 which is pivotally connected to the tubular portion 130 by a living hinge 134. The foam generator 132 is comprised of a planar door 136 having a cylindrical tube 138 extending rearwardly from the door when in the foaming position as shown in FIG. 2. The cylindrical tube 138 includes a cylindrical bore 140 having four equally spaced openings 142 around its periphery adjacent the distal end 144 of the bore 140. The openings 142 are formed as rectilinear slots configured to permit air to pass between the bore 140 and outer diameter of the cylindrical tube 90 when the foam generator 132 is in the foaming position. As shown in FIG. 2, the door 136 extends downwardly past the tubular portion 130 of the nozzle 32 when the foam generator is in the foaming position. A tab 146 at the bottom of the door as shown in FIG. 2, may be gripped by a user to pivot the generator between the foaming position shown and a non-foaming position wherein the door extends upwardly from the tubular portion 130.

To use the spray dispenser of the preferred embodiment, the user must first turn the nozzle with respect to the housing such that the axial slots 90 in the nozzle align with the axial grooves 54 in the housing projection. This permits liquid entering the annular cavity 70 to pass through the axial slots 90 to the axial grooves 54 then through the tangential grooves 60 and into the swirl chamber 58 where it is swirled before being dispensed through the nozzle orifice 96 as a spray. When the door is in the non-foaming position, the spray exits the nozzle undisturbed. However, when the door is in the foaming position, the outer flowstreams of the spray impinge the inner surface of the bore 140 and are directed back toward the centerline of the spray so that a turbulence is created in the spray. Because the fluid being dispensed through the liquid dispenser is a foaming liquid, the turbulence entraps air in the liquid and the liquid exits the nozzle as a foam. The air entrapment is further enhanced by aeration due to air being drawn in from the exterior of the nozzle through the openings in the foam generator to the bore. To turn the nozzle to the off position, the user rotates the nozzle about the nozzle centerline to displace the axial slots 92 in the nozzle tube from the axial grooves 54 in the housing projection so that liquid cannot pass through the slots and into the swirl chamber.

Figure 7:
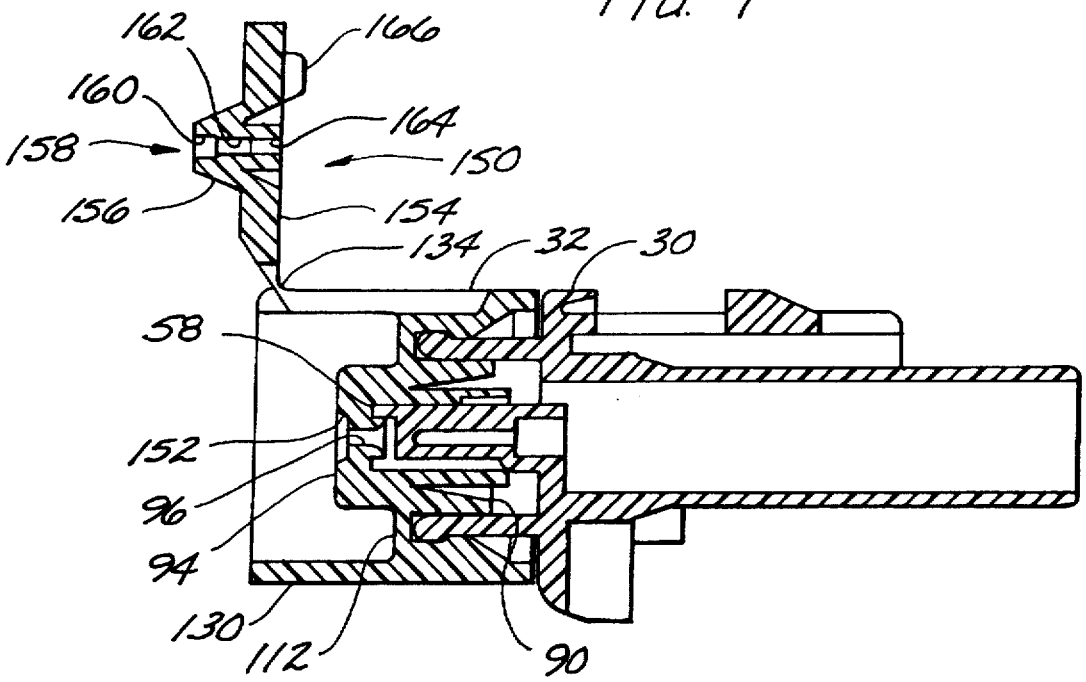
FIG. 7 is a cross-sectional view of the stream/spray, on/off nozzle of the alternate embodiment with the nozzle shown in the on position and the stream generator in the spray position.
Figure 8:
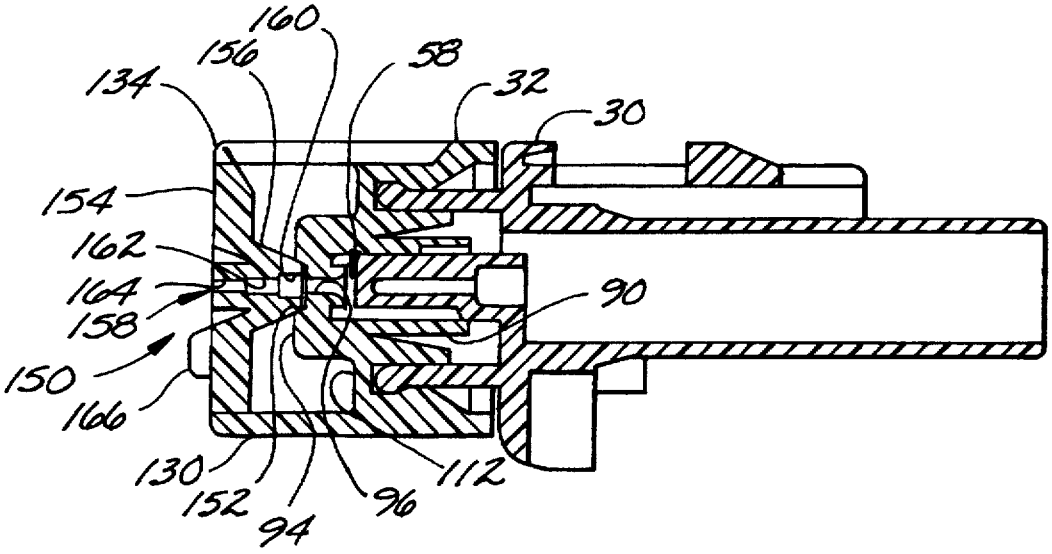
FIG. 8 is a cross-sectional view of the stream/spray, on/off nozzle shown with the nozzle in the "on" position and the stream generator in the stream position.

An alternate embodiment is shown in FIGS. 7 and 8. This embodiment is similar to that disclosed above and shown in FIG. 2 except that a stream generator is substituted for the foam generator 132. Otherwise, with a few minor exceptions, the embodiment of FIGS. 7 and 8 is identical to that of FIG. 2. The common features will not be described again for brevity. Similar features of the embodiments will be identically numbered for convenience and clarity.

As with the previously described embodiment, the nozzle 32 includes a cylindrical tube 90 having an end wall 94. However, the end wall 94 of the alternate embodiment includes a frustoconical recess 152 which surrounds the orifice 96 extending through the wall. The stream generator 150 seats within this recess 152 when in the stream position shown in FIG. 8.

The tubular portion 130 of the nozzle 32 extends forwardly from the annular flange 112 as with the previously described embodiment, and the stream generator 150 is pivotally connected to the tubular portion by a living hinge 134. The stream generator 150 is comprised of a substantially planar door 154 having a frustoconical protrusion 156 extending rearwardly from the door when in the stream position as shown in FIG. 8 to seal against the frustoconical recess 152. The projection 156 includes a straight passage 158 having three sections 160, 162, 164. The rearward most section 160 when the door is in the stream position has a diameter slightly larger than the diameter of the orifice 96, the intermediate section 162 has a diameter generally equal to the orifice, and the forward section 164 has a diameter slightly smaller than the diameter of the orifice. The graduated passage 158 formed by the sections 160, 162 164 focuses and accelerates the liquid, which would otherwise exit the orifice 96 as a spray, to cause the liquid to be discharged in a stream. A tab 166 on the forward side of the door as shown in FIG. 8, may be gripped by a user to pivot the generator between the stream position shown in FIG. 8 and the spray position shown in FIG. 7.

The spray dispenser of the alternate embodiment is used much like the dispenser of the preferred embodiment. The nozzle 32 may be rotated with respect to the housing 30 to alternately permit and inhibit liquid to pass through the nozzle orifice 96. When the door 154 is in the spray position shown in FIG. 7, the liquid is dispensed as a spray because the liquid is swirled in the swirl chamber 58 before being dispensed through the nozzle orifice 96. However, when the door is in the stream position as shown in FIG. 8, the diverging flowstreams of the spray are directed along the centerline of the straight passage 158. Because of the decreasing diameters of the rearward, intermediate and forward sections 160, 162, 164 of the passage 158, the liquid accelerates as it passes through the passage to produce a generally cylindrical stream discharge pattern having a relatively high velocity.

While the present invention has been described by reference to a specific embodiment, it should be understood that modifications and variations of the invention may be constructed without departing from the scope of the invention defined in the following claims.

What is claimed is:

1. A liquid dispenser comprising:

a dispenser head having a manually activated pump and having a connector for attaching the dispenser head to a liquid container to draw a liquid from the container and pump the liquid from the dispenser head in response to manual actuation of the pump;

a nozzle rotatably mounted on the dispenser head for rotation of the nozzle about a first axis between an "on" position and an "off" position of the nozzle relative to the dispenser head, the nozzle having a discharge orifice for dispensing the liquid pumped from the dispenser head when the nozzle is in the "on" position relative to the dispenser head, the nozzle blocking the liquid pumped from the dispenser head and preventing the liquid from being dispensed when the nozzle is in the "off" position relative to the dispenser head; and, a discharge pattern selector pivotally mounted on the nozzle for rotation of the selector about a second axis between a first position and a second position of the selector relative to the nozzle, the second axis being generally perpendicular to the first axis, the discharge pattern selector being configured so that when in the first position the liquid is dispensed in a first discharge pattern and when in the second position the liquid is dispensed in a second discharge pattern different from the first pattern.

2. The liquid dispenser of claim 1 wherein:

the liquid is pumped from the dispenser head as a spray when the nozzle is in the "on" position relative to the dispenser head;

the nozzle blocks the liquid pumped from the dispenser head and prevents the liquid from being dispensed as a spray when the nozzle is in the "off" position relative to the dispenser head; and, the discharge pattern selector is a foam generator, when in the first position the generator is positioned adjacent the nozzle discharge orifice so that the liquid dispensed from the discharge orifice will strike the generator creating turbulence in the liquid spray and thereby foaming the liquid spray, and when in the second position the generator is displaced from the discharge orifice so that the liquid dispensed from the discharge orifice does not strike the generator and is dispensed as a spray.

3. The liquid dispenser of claim 1 wherein:

the liquid is pumped from the dispenser head as a spray when the nozzle is in the "on" position relative to the dispenser head;

the nozzle blocks the liquid pumped from the dispenser head and prevents the liquid from being dispensed as a spray when the nozzle is in the "off" position relative to the dispenser head; and, the discharge pattern selector is a stream generator having a straight passage extending therethrough, when in the first position the generator is positioned adjacent the nozzle discharge orifice so that the liquid dispensed from the discharge orifice will pass through the passage to focus the liquid into a stream, and when in the second position the generator is displaced from the discharge orifice so that the spray dispensed from the discharge orifice does not pass through the passage and is dispensed as a spray.

4. The liquid dispenser of claim 1, wherein:

the dispenser head includes a spinner having a liquid swirl chamber formed thereon and the nozzle is mounted on the spinner for rotation of the nozzle between the "on" and "off" positions of the nozzle relative to the dispenser head and the spinner.

5. The liquid dispenser of claim 4, wherein:

the spinner has a cylindrical exterior surface with at least one groove formed therein, the groove channels liquid pumped from the dispenser head to the swirl chamber, and the nozzle has a cylindrical tube with an interior surface that surrounds the exterior surface of the spinner, the interior surface has at least one slot formed therein, the slot is aligned with the groove to channel liquid pumped from the dispenser head to the groove when the nozzle is in the "on" position relative to the dispenser head, and the slot is displaced from the groove preventing liquid pumped from the dispenser head from reaching the groove when the nozzle is in the "off" position relative to the dispenser head.

6. A liquid dispenser comprising:

a dispenser head having a manually activated pump and having a connector for attaching the dispenser head to a liquid container to draw a liquid from the container and pump the liquid from the dispenser head in response to manual actuation of the pump;

a nozzle mounted on the dispenser head for movement of the nozzle between an "on" position and an "off" position of the nozzle relative to the dispenser head, the nozzle having a discharge orifice for dispensing the liquid pumped from the dispenser head as a spray when the nozzle is in the "on" position relative to the dispenser head, the nozzle blocking the liquid pumped from the dispenser head and preventing its being dispensed as a spray when the nozzle is in the "off" position relative to the dispenser head; and, a foam generator configured for foaming the liquid, the foam generator being pivotally mounted on the nozzle for pivoting movement of the generator relative to the nozzle between a foam position and a spray position of the generator relative to the nozzle, wherein when in the foam position the generator is positioned adjacent the nozzle discharge orifice so that the spray dispensed from the discharge orifice will strike the generator creating turbulence in the spray and thereby foaming the spray, and when in the spray position the generator is displaced from the discharge orifice so that the spray dispensed from the discharge orifice will not strike the generator.

7. The liquid dispenser of claim 6, wherein:

the nozzle is mounted for rotation on the dispenser head between the "on" and "off" positions of the nozzle relative to the dispenser head.

8. The liquid dispenser of claim 7, wherein:

the foam generator is mounted on the nozzle by a hinge for pivoting movement of the generator about the hinge between the foam and spray positions of the generator relative to the nozzle and for rotational movement of the generator relative to the dispenser head with the nozzle as the nozzle is rotated between the "on" and "off" positions of the nozzle relative to the dispenser head.

9. The liquid dispenser of claim 8, wherein:

the foam generator has a tubular bore with a center axis and axially spaced input and output ends, and when the generator is in the foam position relative to the nozzle the input end of the tubular bore surrounds the nozzle discharge orifice.

10. The liquid dispenser of claim 9, wherein:

the hinge is connected between the output end of the tubular bore and the nozzle.

11. The liquid dispenser of claim 6, wherein:

the dispenser head includes a spinner having a liquid swirl chamber formed thereon and the nozzle is mounted on the spinner for movement of the nozzle between the "on" and "off" positions of the nozzle relative to the dispenser head and the spinner.

12. The liquid dispenser of claim 11, wherein:

the spinner has a cylindrical exterior surface with at least one groove formed therein, the groove channels liquid pumped from the dispenser head to the swirl chamber, and the nozzle has a cylindrical tube with an interior surface that surrounds the exterior surface of the spinner, the interior surface has at least one slot formed therein, the slot is aligned with the groove to channel liquid pumped from the dispenser head to the groove when the nozzle is in the "on" position relative to the dispenser head, and the slot is displaced from the groove preventing liquid pumped from the dispenser head from reaching the groove when the nozzle is in the "off" position relative to the dispenser head.

13. The liquid dispenser of claim 12, wherein:

the nozzle is mounted on the spinner for rotation of the nozzle between the "on" and "off" positions of the nozzle relative to the dispenser head and the spinner.

14. The liquid dispenser of claim 13, wherein:

the foam generator is mounted on the nozzle by a hinge for pivoting movement of the foam generator about the hinge between the foam and spray positions of the generator relative to the nozzle and for rotational movement of the foam generator with the nozzle as the nozzle is rotated between the "on" and "off" positions of the nozzle relative to the dispenser head.

15. A nozzle assembly for use with a fluid dispenser in dispensing a liquid substance from a container attached to the dispenser, the nozzle assembly comprising:

a body configured for rotatable attachment to the fluid dispenser, the body including an orifice configured to dispense the fluid substance as a spray; and a bore connected to the body for movement between a foaming position and a non-foaming position, the bore being positioned adjacent the orifice when in the foaming position and remote from the orifice when in the non-foaming position, the bore being connected to the body throughout the movement of the bore between its foaming and non-foaming positions.

16. The nozzle assembly of claim 15 further comprising:

a hinge positioned between the body and the bore, the hinge being configured to permit pivotal movement between the body and the bore.

17. The nozzle assembly of claim 15 wherein the bore comprises an opening for aerating the spray passing through the bore.

18. The nozzle assembly of claim 17 wherein:

the bore extends between a first end adjacent the orifice and a second end opposite the first end when the bore is in the foaming position; and the opening is adjacent the first end of the bore.

19. The nozzle assembly of claim 15 further comprising a cylindrical tube extending from the body for rotatably attaching the body to the fluid dispenser.

20. The nozzle assembly of claim 19 wherein:

the fluid dispenser includes a cylindrical projection having a groove therein, the tube being configured to engage the projection to rotatably attach the body to the dispenser; and the tube includes a slot configured to selectively associate with the groove in the fluid dispenser projection to permit the fluid substance to pass through the body orifice and to selectively disassociate with the groove in the fluid dispenser projection to inhibit the fluid substance from passing through the body orifice.

21. A liquid dispenser comprising:

a dispenser head having a manually activated pump and having a connector for attaching the dispenser head to a liquid container to draw a liquid from the container and pump the liquid from the dispenser head in response to manual actuation of the pump;

a nozzle mounted on the dispenser head for movement of the nozzle between an "on" position and an "off" position of the nozzle relative to the dispenser head, the nozzle having a discharge orifice for dispensing the liquid pumped from the dispenser head as a spray when the nozzle is in the "on" position relative to the dispenser head, the nozzle blocking the liquid pumped from the dispenser head and preventing its being dispensed as a spray when the nozzle is in the "off" position relative to the dispenser head; and, a stream generator mounted on the nozzle for movement of the generator relative to the nozzle between a stream position and a spray position, the generator including a straight passage extending therethrough, wherein when in the stream position the generator is positioned adjacent the nozzle discharge orifice and is configured so that the spray dispensed from the discharge orifice will enter the generator passage and be focussed into a stream as it exits, and when in the spray position the generator is displaced from the discharge orifice so that the spray dispensed from the discharge orifice will not enter the generator passage, the stream generator being connected to the nozzle throughout the movement of the stream generator between its stream and spray positions.

22. The liquid dispenser of claim 21, wherein:

the nozzle is mounted for rotation on the dispenser head between the "on" and "off" positions of the nozzle relative to the dispenser head.

23. The liquid dispenser of claim 22, wherein:

the stream generator is mounted on the nozzle by a hinge for pivoting movement of the generator about the hinge between the stream and spray positions of the generator relative to the nozzle and for rotational movement of the generator relative to the dispenser head with the nozzle as the nozzle is rotated between the "on" and "off" positions of the nozzle relative to the dispenser head.

24. The liquid dispenser of claim 21, wherein:

the dispenser head includes a spinner having a liquid swirl chamber formed thereon and the nozzle is mounted on the spinner for movement of the nozzle between the "on" and "off" positions of the nozzle relative to the dispenser head and the spinner.

25. The liquid dispenser of claim 24, wherein:

the spinner has a cylindrical exterior surface with at least one groove formed therein, the groove channels liquid pumped from the dispenser head to the swirl chamber, and the nozzle has a cylindrical tube with an interior surface that surrounds the exterior surface of the spinner, the interior surface has at least one slot formed therein, the slot is aligned with the groove to channel liquid pumped from the dispenser head to the groove when the nozzle is in the "on" position relative to the dispenser head, and the slot is displaced from the groove preventing liquid pumped from the dispenser head from reaching the groove when the nozzle is in the "off" position relative to the dispenser head.

26. The liquid dispenser of claim 25, wherein:

the nozzle is mounted on the spinner for rotation of the nozzle between the "on" and "off" positions of the nozzle relative to the dispenser head and the spinner.

27. The liquid dispenser of claim 26, wherein:

the stream generator is mounted on the nozzle by a hinge for pivoting movement of the stream generator about the hinge between the stream and spray positions of the generator relative to the nozzle and for rotational movement of the foam generator with the nozzle as the nozzle is rotated between the "on" and "off" positions of the nozzle relative to the dispenser head.

28. A nozzle assembly for use with a fluid dispenser in dispensing a liquid substance from a container attached to the dispenser, the nozzle assembly comprising:

a body configured for rotatable attachment to the fluid dispenser, the body including an orifice configured to dispense the fluid substance as a spray; and a straight passage connected to the body for movement between a stream and a spray position, the passage being positioned adjacent the orifice when in the stream position and remote from the orifice when in the spray position, the straight passage being connected to the body throughout the movement of the straight passage between its stream and spray positions.

29. The nozzle assembly of claim 28 further comprising:

a hinge positioned between the body and the passage, the hinge being configured to permit pivotal movement between the body and the passage.

30. The nozzle assembly of claim 28 further comprising a cylindrical tube extending from the body for rotatably attaching the body to the fluid dispenser.

31. The nozzle assembly of claim 30 wherein:

the fluid dispenser includes a cylindrical projection having a groove therein, the tube being configured to engage the projection to rotatably attach the body to the dispenser; and the tube includes a slot configured to selectively associate with the groove in the fluid dispenser projection to permit the fluid substance to pass through the body orifice and to selectively disassociate with the groove in the fluid dispenser projection to inhibit the fluid substance from passing through the body orifice.

* * * * *